US009878834B2

(12) United States Patent
Azelton et al.

(10) Patent No.: US 9,878,834 B2
(45) Date of Patent: Jan. 30, 2018

(54) SMOOTH POUR CONTAINER

(71) Applicant: THE CLOROX COMPANY, Oakland, CA (US)

(72) Inventors: Kerry D. Azelton, Pleasanton, CA (US); Vincent N. DeMaso, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 136 days.

(21) Appl. No.: 14/168,776

(22) Filed: Jan. 30, 2014

(65) Prior Publication Data

US 2015/0210447 A1 Jul. 30, 2015

(51) Int. Cl.
*B65D 47/08* (2006.01)
*B65D 47/32* (2006.01)

(52) U.S. Cl.
CPC ..... *B65D 47/32* (2013.01); *B65D 47/0814* (2013.01); *Y10T 29/49826* (2015.01)

(58) Field of Classification Search
CPC ..... B65D 47/06; B65D 47/32
USPC ..... 222/468, 481.5
See application file for complete search history.

(56) References Cited

U.S. PATENT DOCUMENTS 3,307,752 A * 3/1967 Anderson ..... B65D 23/108 215/306
4,838,464 A * 6/1989 Briggs ..... B65D 23/00 215/382
5,303,851 A 4/1994 Libit et al.
5,638,994 A 6/1997 Libit et al.
6,155,462 A 12/2000 Brechelsen et al.
6,213,358 B1 4/2001 Libit et al.
7,478,739 B2 1/2009 Foster
8,038,040 B2 10/2011 Dennis
D651,907 S 1/2012 Dennis et al.
2004/0238066 A1 12/2004 Chrisco et al.
2005/0133546 A1 6/2005 Carvalho
2006/0081662 A1 4/2006 Miura
2008/0210658 A1 9/2008 Jo
2009/0120969 A1 5/2009 Hughes et al.
2009/0314811 A1 12/2009 Dennis
2010/0096414 A1 4/2010 Dennis
2011/0024453 A1 2/2011 Fleisher
2011/0036927 A1 2/2011 Hensen
2011/0108447 A1 5/2011 Hoefing
(Continued)

FOREIGN PATENT DOCUMENTS

JP 2002179042 A 6/2002
JP 2002337905 A 11/2002
(Continued)

*Primary Examiner* — Nicholas J Weiss
(74) *Attorney, Agent, or Firm* — Erin Collins

(57) ABSTRACT

Embodiments provide an apparatus and method for dispensing a fluid, the apparatus including a container capable of retaining the fluid and having a top, bottom, front surface, and rear surface; a dip tube integrally formed with the rear surface of the container, the dip tube having a first end extending toward the top and a second end extending toward bottom; and a spout member mounted to the top of the container, the spout member including a pour spout adjacent the front surface for dispensing the retained fluid and an air vent adjacent the rear surface with a supply line in connection with the first end of the dip tube for directing air into the container.

18 Claims, 7 Drawing Sheets

(56) References Cited

U.S. PATENT DOCUMENTS

| | | | | |
|---|---|---|---|---|
| 2011/0284541 | A1 | 11/2011 | Webster et al. | |
| 2012/0032004 | A1 | 2/2012 | Dejong et al. | |
| 2012/0234871 | A1* | 9/2012 | Good | B05B 11/0016 222/382 |
| 2014/0144948 | A1* | 5/2014 | Brausen | B65D 47/32 222/468 |

FOREIGN PATENT DOCUMENTS

| | | | |
|---|---|---|---|
| JP | 2010083530 | A | 4/2010 |
| WO | 200200519 | A1 | 1/2002 |
| WO | 2006095649 | A1 | 9/2006 |
| WO | 2008024774 | A2 | 2/2008 |
| WO | 2012035445 | A | 3/2012 |

* cited by examiner

SMOOTH POUR CONTAINER

TECHNICAL FIELD

Embodiments herein relate to apparatuses and methods for dispensing a fluid from a container having a dip tube and spout member.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure. Unless otherwise indicated herein, the approaches described in this section are not prior art to the claims in the present disclosure and are not admitted to be prior art by inclusion in this section.

A multitude of applications exist for a container that dispenses a fluid in a smooth and controlled stream. For example, it is often advantageous to pour bleach into a detergent reservoir of a conventional laundry machine without the bleach splashing or creating a mess. A user desiring to manually pour bleach from a container into the reservoir must do so carefully, in a manner that allows air to enter the container to compensate for the vacuum created as the bleach is poured out. If the user pours the bleach too quickly, thereby blocking the container opening, air entering the container as discrete bubbles causes periodic interruptions followed by sudden increases in flow as each bubble passes through the container opening. This creates an undesirable "glugging" effect that may result in missed application, spillage, wasted product, and/or inconvenience to the user. In other solutions, a separate funnel is used to catch uneven fluid flowing out of a container. However, employing a separate and typically small device to aid pouring requires the user to locate and store the device, as well as clean the device before and after use. Accordingly, it would be advantageous to provide an apparatus that conveniently and effectively delivers a steady and controlled stream of fluid without the use of a separate funnelling device.

SUMMARY

Embodiments provide an apparatus for dispensing a fluid, the apparatus including a container capable of retaining the fluid and having a top, bottom, front surface, and rear surface; a dip tube integrally formed with the rear surface of the container, the dip tube having a first end extending toward the top and a second end extending toward the bottom; and a spout member mounted to the top of the container, the spout member including a pour spout adjacent the front surface for dispensing the retained fluid and an air vent adjacent the rear surface with a supply line in connection with the first end of the dip tube for directing air into the container.

Another embodiment provides a process for assembling a container for the even dispensing of fluid. In various embodiments, the process may include, not necessarily in the order recited: (1) selecting a container capable of retaining the fluid, the container having a top, bottom, front surface, rear surface, and dip tube, the dip tube extending downwardly adjacent to the rear surface of the container and having a first end opening into the container adjacent the top and a second end opening into the container adjacent the bottom; and (2) mounting a spout member to the container, the spout member having a pour spout adjacent the front surface and an air vent adjacent the rear surface with a supply line in connection with the first end of the dip tube, such that fluid dispensing from the container through the pour spout is replaced by air entering the container through the air vent to prevent accumulation of negative air pressure.

Another embodiment provides a process for pouring from a container filled with fluid and having a pour spout on a front portion, an air vent at a rear portion, and a bottom. In various embodiment, the process includes tilting the container to pour fluid from the container and directing air into the air vent and downwardly into the bottom of the container though a tube extending from the air vent to the bottom of the container.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF DISCLOSED EMBODIMENTS

Figure 1:
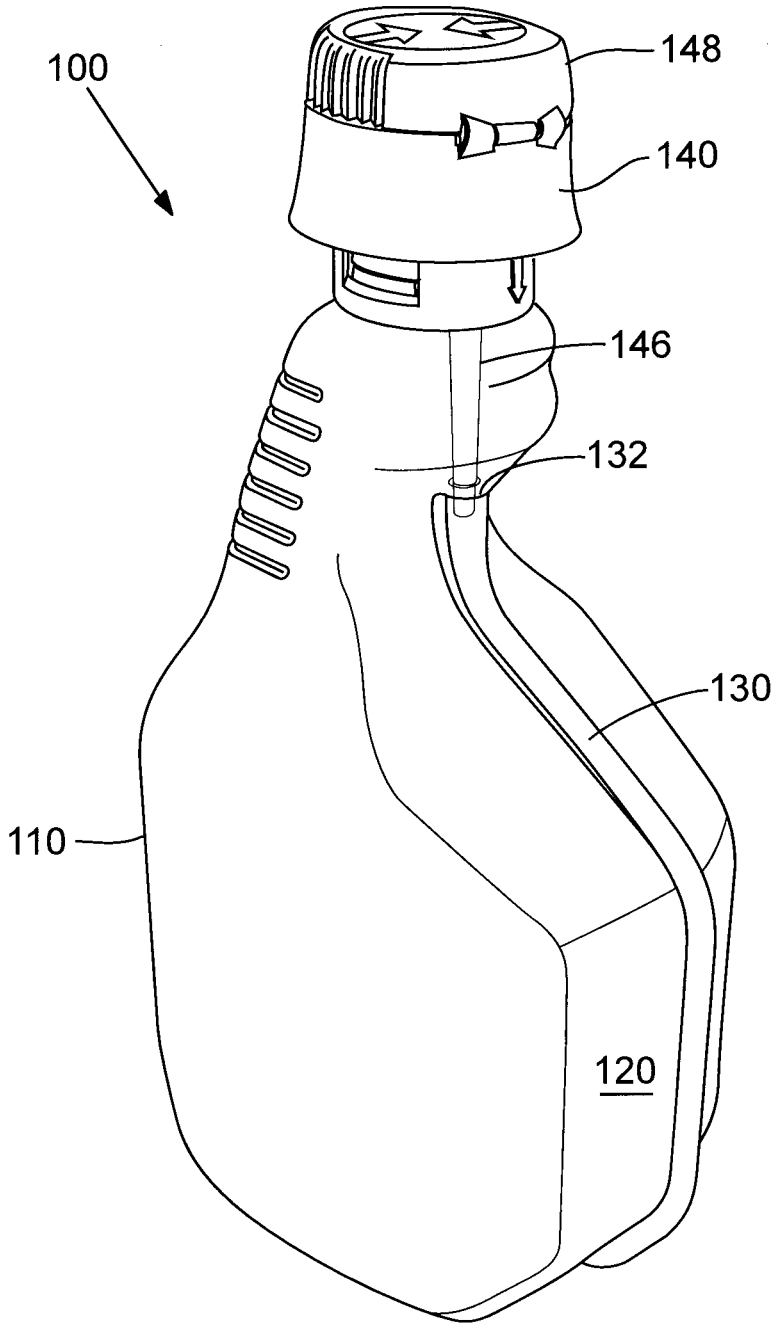
FIG. 1 is a perspective view of a first embodiment of an apparatus for dispensing a fluid.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, proximal/distal, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Reference is made to the drawings wherein like numerals refer to like parts throughout. For ease of description, the components of embodiments of the present disclosure are described in the normal (upright) operating position, and terms such as upper, lower, horizontal, etc., are used with reference to this position. It will be understood, however, that the components of embodiments of the present disclosure may be manufactured, stored, transported, used, and sold in an orientation other than the position described.

Figures illustrating the components of embodiments of the present disclosure show some conventional mechanical elements that may be known and that may be recognized by one skilled in the art. The detailed descriptions of such elements are not necessary to an understanding of the disclosure, and accordingly are herein presented only to the degree necessary to facilitate an understanding of the novel features of the present disclosure.

As used herein and in the appended claims, the term "comprising" is inclusive or open-ended and does not exclude additional unrecited elements, compositional components, or method steps. Accordingly, the term "comprising" encompasses the more restrictive terms "consisting essentially of" and "consisting of."

It must be noted that, as used in this specification and the appended claims, the singular forms "a," "an," and "the" include plural references unless the content clearly dictates otherwise. Similarly, the use of substantially any plural terms herein may be translated by those having skill in the art from the plural to the singular as is appropriate to the context and/or application. The various singular/plural permutations may be expressly set forth herein for sake of clarity.

In those instances where a convention analogous to "at least one of A, B, and C, etc." is used, in general such a construction is intended in the sense one having skill in the art would understand the convention (e.g., "an apparatus having at least one of A, B, and C" would include, but not be limited to, apparatuses that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The description may use the terms "embodiment" or "embodiments," which may each refer to one or more of the same or different embodiments. Furthermore, the terms "comprising," "including," "having," and the like, as used with respect to embodiments, are synonymous.

Unless defined otherwise, all technical and scientific terms used herein have the same meaning as commonly understood by one of ordinary skill in the art to which embodiments of the present invention pertain. Although a number of methods and materials similar or equivalent to those described herein can be used in the practice of the present invention, the preferred materials and methods are described herein.

The containers as described herein may be constructed from one or more polymers, such as polypropylene or high density polyethylene, and manufactured by any suitable method known in the art for shaping plastics. Examples include, but are not limited to, injection molding, blow molding, thermoforming, extrusion, casting, and compression/transfer molding.

The term "fluid" as used herein refers to any type of fluid or liquid generally found in the home or office, including but not limited to cleaning fluids, such as bleach, laundry detergent, and dishwashing detergent, as well as cooking oil, vinegars, drinking fluids, water, motor oil, wiper fluid, fertilizers, or hazardous material. Really, any fluid whose pouring may otherwise involve splashing or spilling, and where that splashing or spilling would be troublesome because of the value of the fluid being poured, if the fluid came into contact with the user or with adjacent surfaces, if the container from which fluid was to be poured had to reach down into a confined space, if for some reason the fluid had to be poured quickly, or if for whatever reason it was perceived by the user that a smooth pour was somehow beneficial. Cleaning fluids that might be beneficially dispensed from such a container might be composed of one or more cleaning agents (e.g., surfactants, detergents), alkalis, oxidizers, petrochemicals/oleochemicals, emulsifiers, thickeners, enzymes, antimicrobials, fragrances, dyes, preservatives, fillers, and/or stabilizers. Some such materials may be non-hypochlorite such that they may be used for brightening articles during a washing cycle. One such cleaning solution is Clorox 2® bleach. In addition, cleaning fluids may take on any semi-solid form such as but not limited to liquids or gels.

Figure 2:
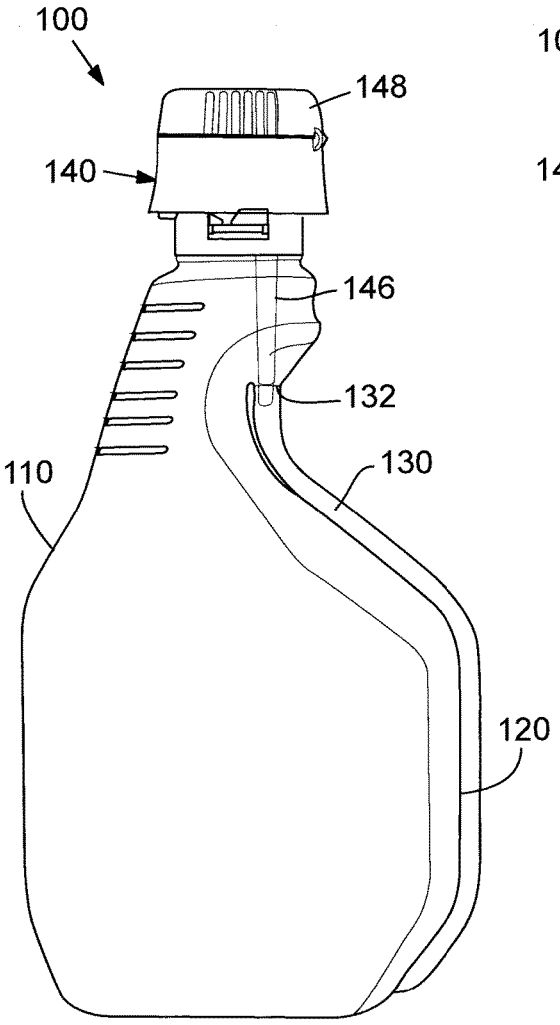
FIG. 2 is a side elevation view of the apparatus depicted in FIG. 1.
Figure 3:
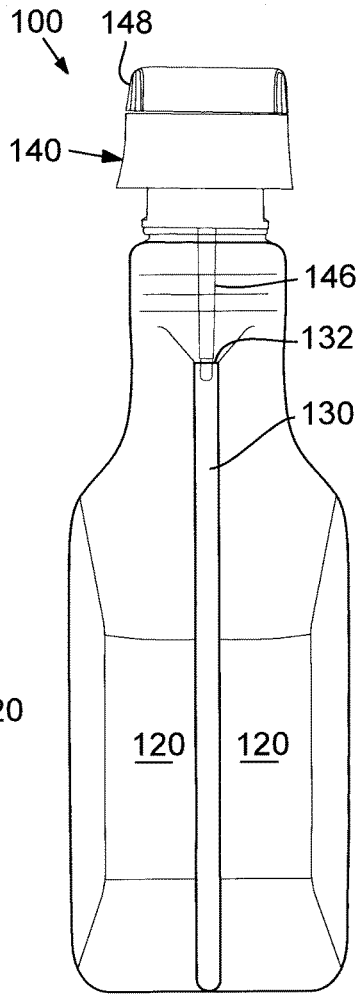
FIG. 3 is an end elevation view of the apparatus depicted in FIG. 1.
Figure 4:
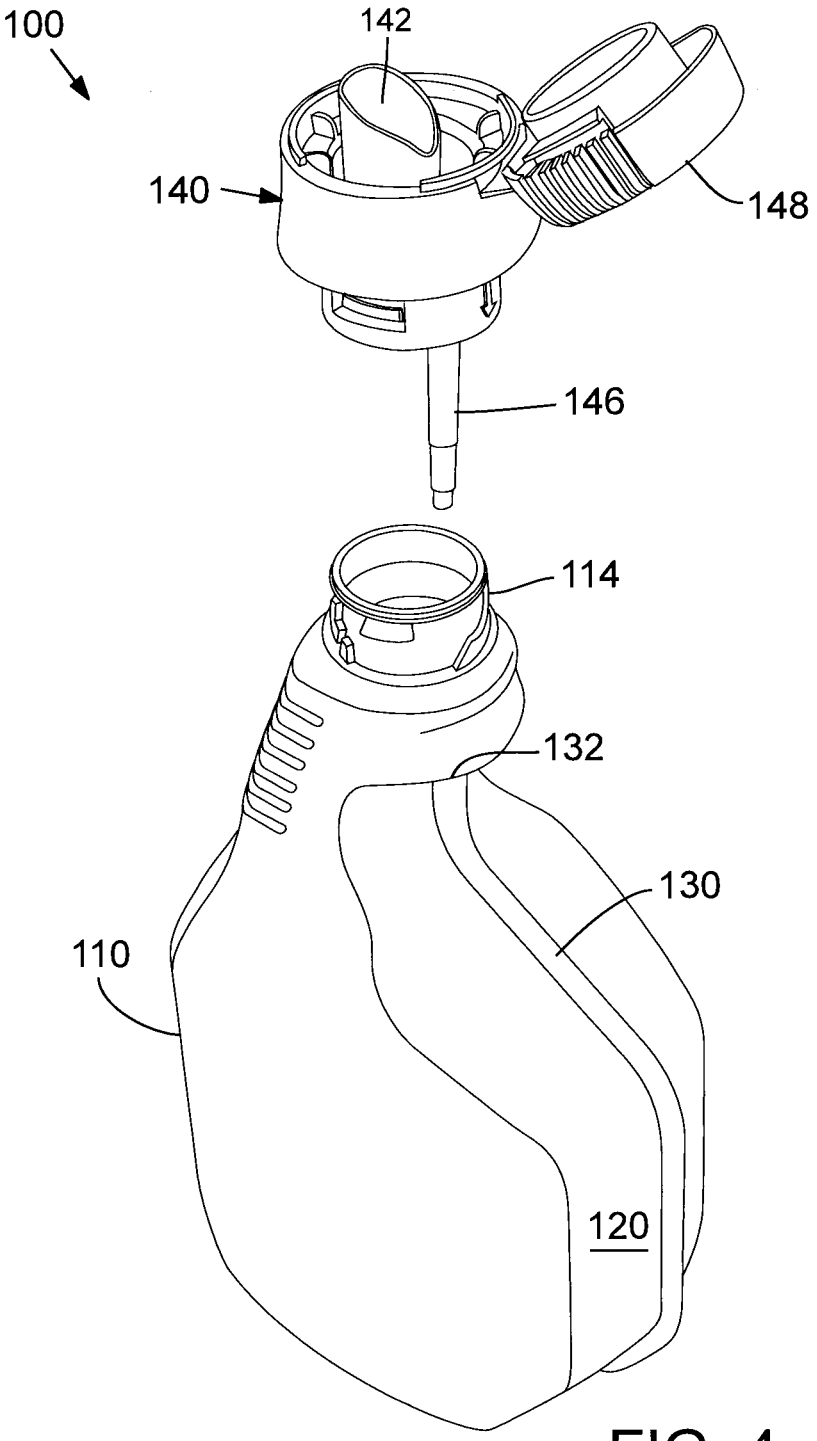
FIG. 4 is a perspective view of the apparatus depicted in FIG. 1, shown with the spout member removed and open.
Figure 5:
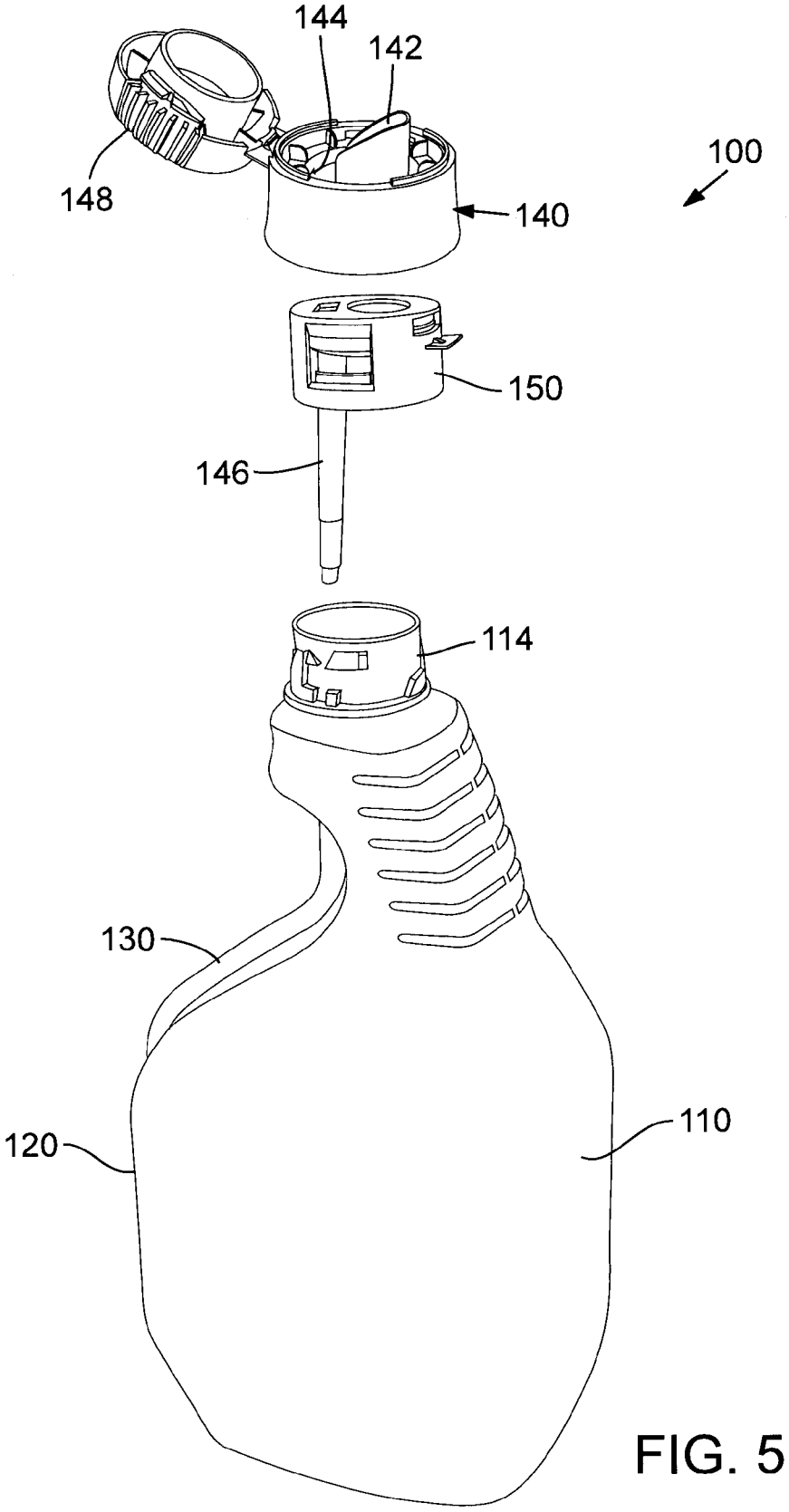
FIG. 5 is a perspective view of the apparatus depicted in FIG. 1, shown with the dip tube removed from the spout member and the spout member open.
Figure 6:
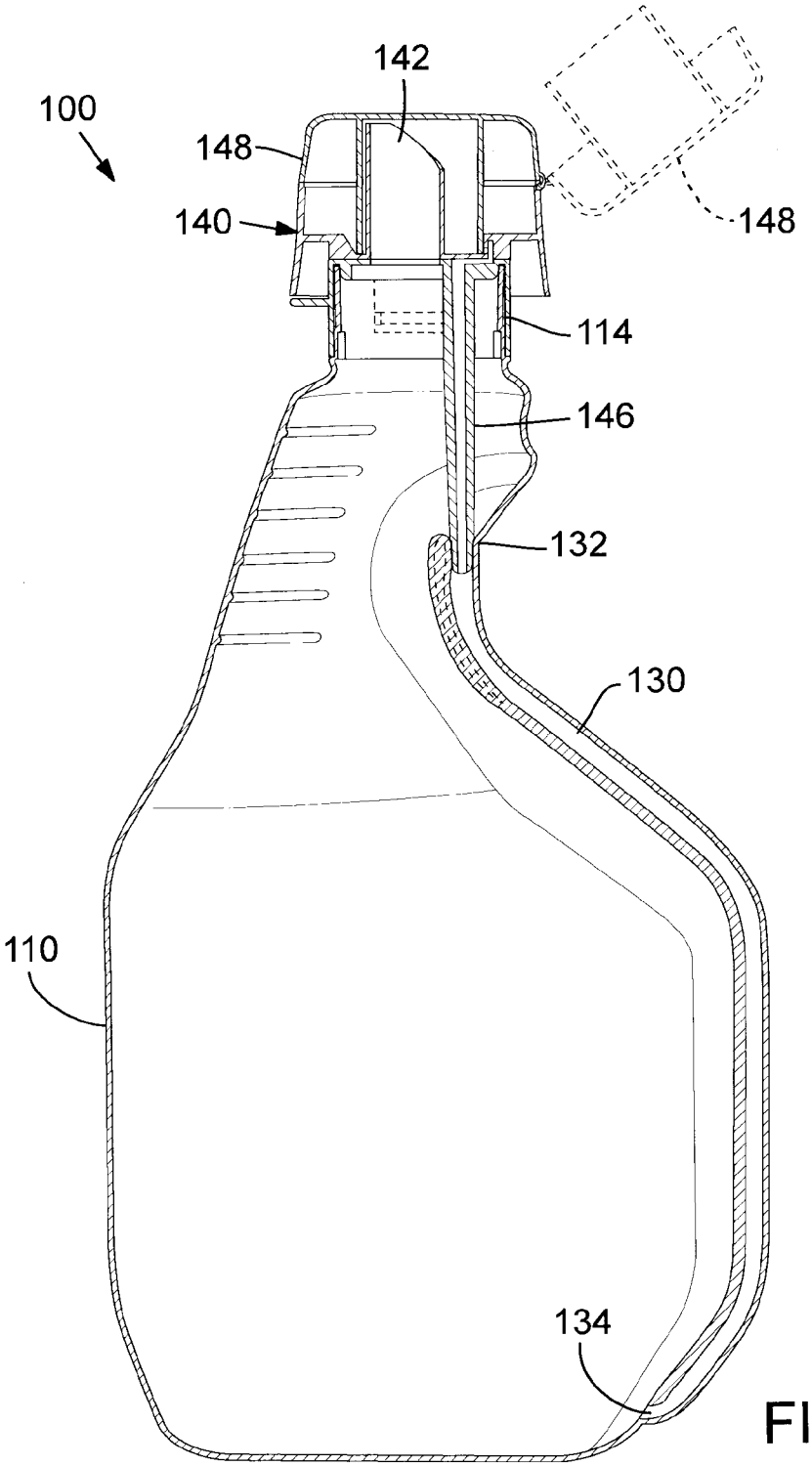
FIG. 6 is a side elevation sectional view of the apparatus depicted in FIG. 1, shown with the spout member open in phantom.
Figure 7:
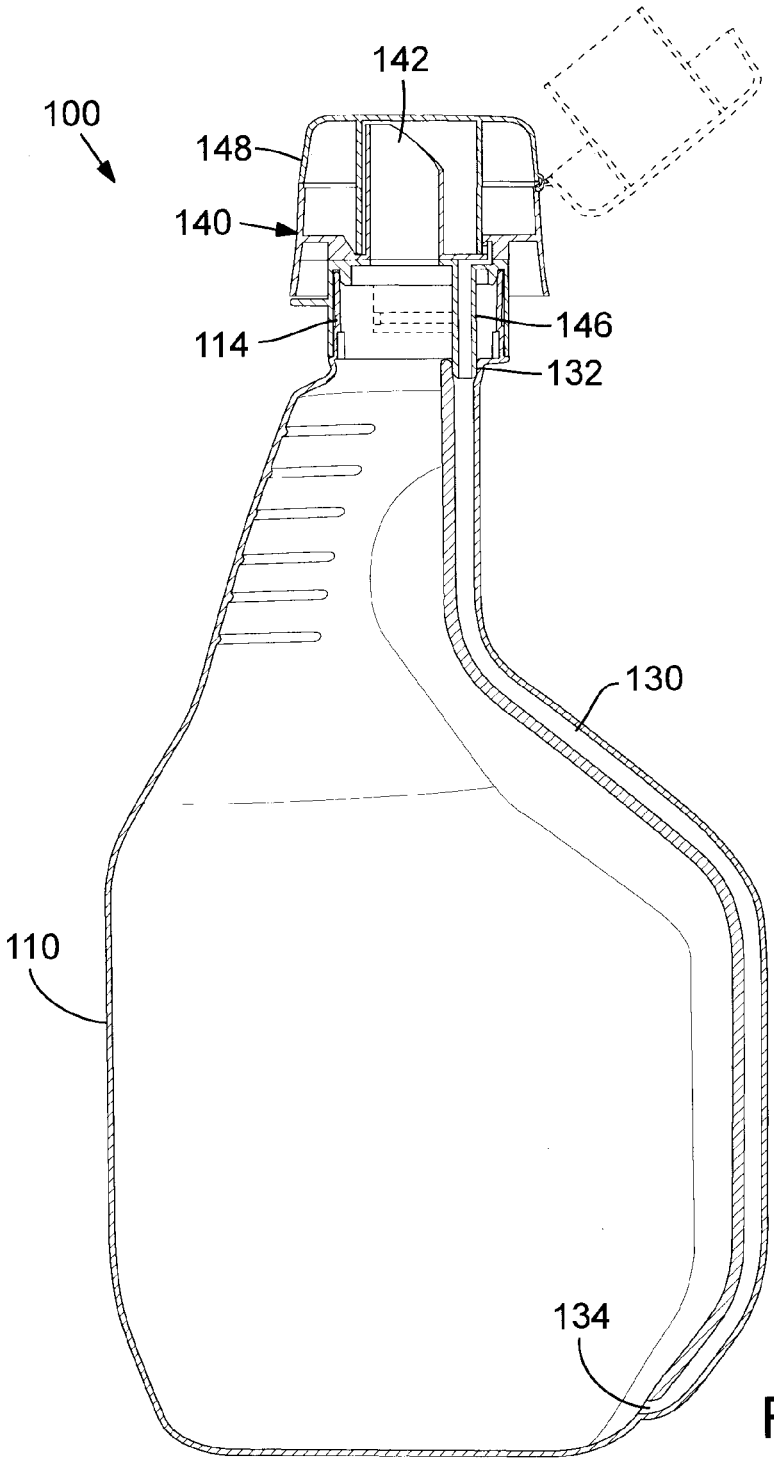
FIG. 7 is a side elevation sectional view of a second embodiment of an apparatus for dispensing a fluid, shown with the spout member open in phantom.
Figure 8:
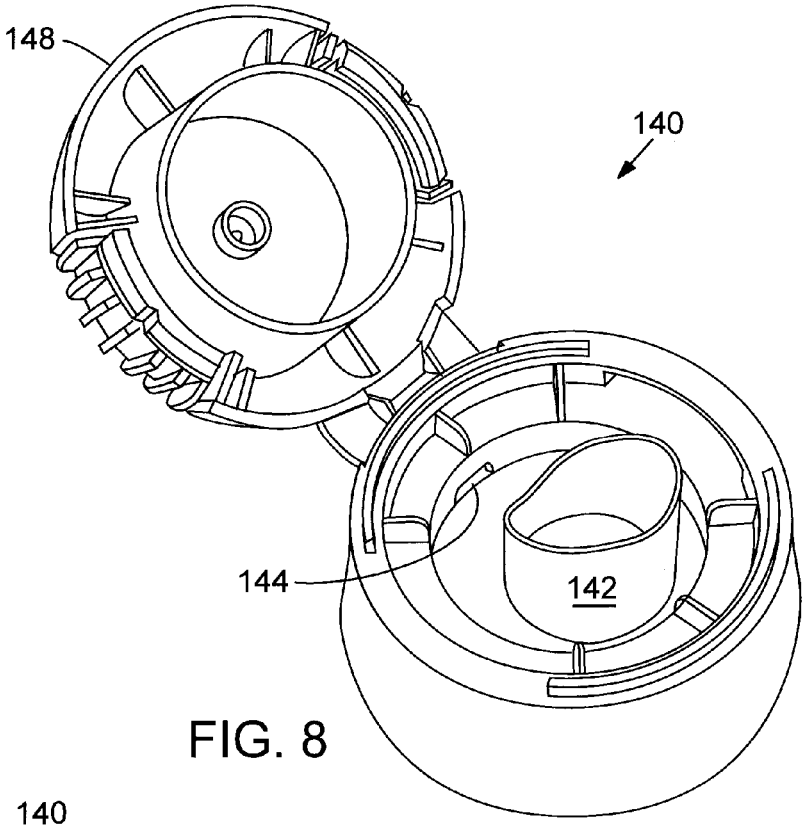
FIG. 8 is an enlarged perspective view of the spout member depicted in FIG. 1, with the spout member open.
Figure 9:
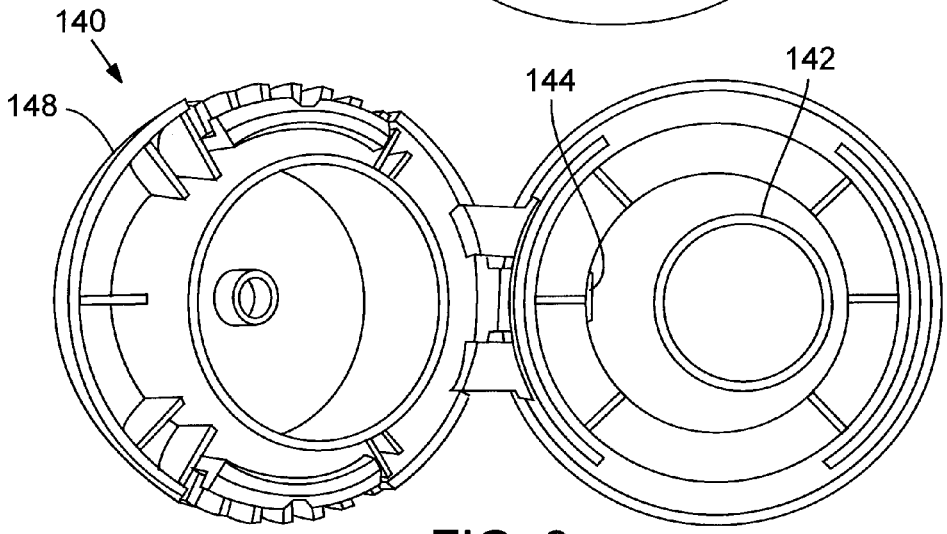
FIG. 9 is an enlarged top plan view of the spout member depicted in FIG. 1, with the spout member open.

FIGS. 1, 2, and 3 are perspective, side, and end views, respectively, of a first embodiment of an apparatus for dispensing a fluid in accordance with various embodiments. FIGS. 4-5 are additional perspective views of the apparatus depicted in FIGS. 1-3, with top components removed and opened. FIG. 6 is a side elevation sectional view of the apparatus depicted in FIGS. 1-3. FIG. 7 is a side elevation sectional view of a second embodiment of an apparatus for dispensing fluid. Finally, FIGS. 8-9 are enlarged perspective and top views, respectively, of a top portion of the apparatus depicted in FIGS. 1-3.

As illustrated in FIGS. 1-5, apparatus 100 may include a container 110 capable of retaining a fluid. Container 110 may further include a top 114 (shown in FIGS. 4, 5), bottom 116 (not shown), front surface 118 (not shown), and rear surface 120 (best shown in FIG. 3). Although the illustrated container 110 is shown as having a particular size and shape, one of skill in the art will appreciate that container 110 may have any shape that is suited for containing, transporting, storing, and/or pouring fluid, and may include one or more handles or other grip features for ease of use. For example, in some embodiments, container 110 may include a single molded pouring handle or grip, dual handles, one or more grip straps, or a central recess or concavity to facilitate grasping of the container body from either side.

In various embodiments, a dip tube 130 may be integrally formed with rear surface 120 or extend downwardly adjacent rear surface 120. As best shown in FIG. 6, dip tube 130 may additionally include a first end 132 opening into container 110 below the top, and a second end 134 opening into container 110 at the bottom. One of skill in the art will appreciate that first end 132 may open into container 110 at or substantially at the top (as shown in FIG. 7), and likewise, second end 134 may open into container 110 at some point above or adjacent the bottom. Additionally, while dip tube 130 is depicted as integrally formed with container 110 or extending downwardly adjacent rear surface 120 in a particular manner in FIG. 1, dip tube 130 may integrally form with container 110 or extend downwardly adjacent rear surface 120 in any manner known to those of skill in the art, including being positioned inside or outside the container, permanently coupled to the container, spaced apart from the container, or separated from the container by a partition or extension of the container.

In various embodiments, a spout member 140 may be mounted to top 114 of container 110, for instance, by a threaded closure, bayonet-type closure, snap fitting, or via any other suitable coupling construction. As shown in FIGS. 4 and 5, spout member 140 may include a pour spout 142 for dispensing fluid retained in container 110. In the depicted embodiment, pour spout 142 is adjacent front surface 118 of container 110, but it may alternatively be in other positions. In various embodiments, spout member 140 may be substantially circular, triangular, trapezoidal, oval, arcuate, conical, or any other shape that lends itself to smooth pouring. In addition, the distally extending end of spout member 140 may be angled, sharp, notched, tapered, curved, or fluted, depending on the desired design and pour characteristics, and/or depending on the viscosity or other characteristics of the fluid. An angled configuration has been determined to be advantageous for encouraging smooth flow and minimizing excess dripping from spout member 140.

Referring to FIGS. 8 and 9, spout member 140 may further include an air vent 144. While air vent 144 is depicted as disposed adjacent rear surface 120 of container 110, air vent 144 may be positioned elsewhere on spout member 140. It has been determined that when pour spout 142 is positioned adjacent front surface 118 of container 110, it may be beneficial for air vent 144 to be positioned diametrically opposed to the pour spout, adjacent rear surface 120 of the container. Although air vent 114 is depicted in the figures as a slot, one of skill in the art will appreciate that air vent 114 may have any shape that is suited for allowing the passage of air into the container, such as but not limited to, rectangular, triangular, trapezoidal, round, oval, etc.

As shown in FIGS. 6 and 7, air vent 144 may include a supply line 146 in connection with first end 132 of the dip tube for receiving air into container 110. The distally extending end of supply line 146 mates with first end 132 of the dip tube, forming a connection that is, in some embodiments, air tight. As stated above, one of skill in the art will appreciate that the location at which supply line 146 and first end 132 mate may vary, including at the top, substantially at the top, or below the top of container 110. In some embodiments, at least the mating portions of supply line 146 and/or dip tube 130 may be formed of a soft or resilient material, such as ethylene vinyl acetate ("EVA"), to facilitate an air tight connection between supply line 146 and first end 132 of the dip tube. As depicted, the size of supply line 146 may correspond to that of first end 132 of dip tube 130. In other embodiments (not shown), the first end of the dip tube may be conical or funnel-shaped to ease mounting of the supply line to it.

In various embodiments, apparatus 100 may include a closure member 148 for preventing accidental spills during transport and/or storage. The embodiment illustrated in the figures depicts closure member 148 as a flip cap pivotally coupled to spout member 140. Although the illustrated closure member 148 is a flip cap, one of ordinary skill in the art will appreciate that closure member 148 may take on other configurations, such as but not limited to, a snap cap or twist-off cap, etc. In yet other embodiments, closure member 148 may be removably coupled to one or more of spout member 140 and container 110 and configured for measuring out a desired amount of fluid. In such embodiments, closure member 148 may include one or more fill lines or other indicia (not shown) to facilitate accurate measuring of the fluid.

In various embodiments, an annular member 150 may define supply line 146 and facilitate mounting spout member 140 to container 110. As shown in FIG. 5, annular member 150 may include apertures corresponding to pour spout 142 and air vent 144. Annular member 150 may be permanently or removably coupled to the interior of spout member 140 and then coupled to container 102, for example in, on, or around top 114, a neck region, or other opening in container 110. Further, annular member 150 may couple to container 110 in any manner known to those of skill in the art, for example, with a threaded coupling, a ratchet or bayonet style coupling, a snap fitting, or any other type of coupling that creates a fluid-tight seal. In some embodiments, once coupled, annular member 150 may be rotatable about a central rotational axis, and in other embodiments, annular member 150 may be rotationally fixed with respect to container 110 once coupled. In some embodiments, annular member 150 may be permanently coupled to container 102.

During operation and pouring, container 110 retaining a fluid is partially inverted in the direction of front surface 118 and pour spout 142. Retained fluid flows through container 110, along the inner front surface 118, and exits through pour spout 142. As fluid exits container 110 through pour spout 142, air simultaneously flows into air vent 144, through supply tube 146 and dip tube 130, and enters container 110 through second end 134 of dip tube 130. Because fluid is gathered toward the top-front portion of container 110 adjacent pour spout 142 during operation and pouring, the rear-bottom portion of container 110 is fluid-free or substantially fluid-free, thereby allowing air to enter container 110 through second end 134. The simultaneous ingress of air with the simultaneous egress of fluid ensures minimal to no accumulation of negative air pressure in container 110, resulting in a smooth and controlled pour.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed:

1. An apparatus for dispensing a fluid, the apparatus comprising:

a container capable of retaining the fluid and having a top, bottom, front surface, and rear surface;

a dip tube integrally formed exterior to the rear surface of the container, separated from the rear surface by a partition, and the dip tube having a first end extending toward the top and opening into the container below the top on the rear surface and a second end extending toward the bottom and opening into the container on the rear surface, adjacent to the bottom, which allows air to enter the container through the second end such that a simultaneous ingress of air with a simultaneous egress of the retained fluid ensures minimal to no accumulation of negative air pressure in the container; and a spout member mounted to the top of the container, the spout member having (i) a spout member surface, (ii) a pour spout adjacent the front surface having a distally extending end that extends from the spout member surface in a first direction for dispensing the retained fluid, (iii) an air vent adjacent the rear surface, and (iv) a supply line that extends from the air vent having a distal end extending from the spout member surface in a second direction away from the pour spout distally extending end;

wherein the supply line distal end is configured to be moved substantially axially into the container toward the first end of the dip tube such that the distal end mates with the first end of the dip tube to form an air tight connection below the top of the container with the first end of the dip tube for directing the ingress of air into the container.

2. The apparatus of claim 1, wherein the first end of the dip tube has a conical shape.

3. The apparatus of claim 1, wherein the apparatus further comprises a closure member for closing the spout member.

4. The apparatus of claim 3, wherein the closure member is a flip cap pivotally coupled to the spout member.

5. The apparatus of claim 3, wherein the closure member is a twist cap removably coupled to the spout member or container.

6. The apparatus of claim 1, wherein the pour spout has a sharp lip adjacent the front surface of the container to facilitate a clean termination of the dispensing.

7. The apparatus of claim 1, wherein the pour spout has an angled lip adjacent the front surface of the container to facilitate a clean termination of the dispensing.

8. The apparatus of claim 1, wherein at least a portion of the end of the supply line in connection with the dip tube is formed of a soft material to facilitate the mating and the air tight connection between the supply line and the dip tube.

9. The apparatus of claim 1, wherein the pour spout is greater in a lateral dimension than the air vent.

10. The apparatus of claim 1, wherein the spout member is removably mounted to the container by a bayonet-type coupling.

11. The apparatus of claim 1, further comprising an annular member defining the supply line to facilitate mounting the spout member to the top of the container.

12. The apparatus of claim 1, wherein the pour spout and air vent are diametrically opposed to each other.

13. A process for assembling an apparatus for the even dispensing of fluid, comprising the following:

selecting a container capable of retaining the fluid, the container having a top, bottom, front surface, rear surface, and a dip tube, the dip tube integrally formed exterior to the rear surface of the container separated from the rear surface by a partition, and having a first end opening into the container below the top and a second end opening into the container on the rear surface, adjacent to the bottom, which allows air to enter the container through the second end such that the simultaneous ingress of air with the simultaneous egress of fluid ensures minimal to no accumulation of negative air pressure in container; and mounting a spout member to the container, the spout member having (i) a spout member surface, (ii) a pour spout adjacent the front surface having a distally extending end that extends from the spout member surface in a first direction, (iii) an air vent adjacent the rear surface, and (iv) a supply line that extends from the spout member surface in a second direction away from the first direction;

wherein mounting the spout member to the container includes moving the supply line substantially axially toward the bottom and into the container such that a distal end mates with the first end of the dip tube and forms an air tight connection below the top of the container with the first end of the dip tube, such that fluid dispensing from the container through the pour spout is replaced by air entering the container through the air vent.

14. The process of claim 13, wherein the second end opens into the container at the bottom.

15. The process of claim 13, further comprising filling the container with the fluid.

16. The process of claim 13, wherein the step of mounting the spout member to the container comprises removably mounting the spout member to the container using a bayonet-type coupling.

17. The process of claim 13, further comprising positioning a closure member over the spout member and mounting the closure member to one or more of the container and the spout member to prevent inadvertent spilling of the fluid.

18. The process of claim 13, wherein the pour spout is diametrically opposed to the air vent.

* * * * *